US005312276A

United States Patent [19]

Hnatuck et al.

[11] Patent Number: 5,312,276

[45] Date of Patent: May 17, 1994

[54] CONNECTOR POLARIZING STRUCTURE

[75] Inventors: Robert J. Hnatuck; John R. Shuey, both of Mechanicsburg, Pa.

[73] Assignee: The Whitaker Corporation, Wilmington, Del.

[21] Appl. No.: 35,132

[22] Filed: Mar. 19, 1993

[51] Int. Cl.[5] ..... H01R 13/64

[52] U.S. Cl. ..... 439/681; 439/701

[58] Field of Search ..... 439/78, 79, 680, 681, 439/686, 701, 350, 357, 372

[56] References Cited

U.S. PATENT DOCUMENTS

| | | | |
|---|---|---|---|
| 3,325,771 | 6/1967 | Ruehlemann et al. | 439/681 |
| 4,345,813 | 8/1982 | Hatch | 439/681 |
| 4,506,949 | 3/1985 | Knop | 350/162.19 |
| 4,580,868 | 4/1986 | Verstijnen | 439/680 |
| 4,773,881 | 9/1988 | Adams, III | 439/681 |
| 4,884,975 | 12/1989 | Pelzl et al. | 439/78 |
| 4,984,992 | 1/1991 | Beamenderfer et al. | 439/108 |

FOREIGN PATENT DOCUMENTS

| | | | |
|---|---|---|---|
| 2021547 | 11/1971 | Fed. Rep. of Germany | 439/680 |

*Primary Examiner*—Neil Abrams
*Assistant Examiner*—Khiem Nguyen
*Attorney, Agent, or Firm*—Gerald K. Kita

[57] ABSTRACT

An external key (24) on a connector (12), the key being adapted with multiple slots (35) in a clip (25), rails (36) in the slots (35) being shorter in length than the slots (35), projecting posts (38) on the connector (12) received in the slots (35), projecting latches (40) on the connector (12), and the clip (25) being slidable to move the rails (36) into channels (39) of the posts (38), and to latch the clip (25) against the latches (40).

14 Claims, 5 Drawing Sheets

CONNECTOR POLARIZING STRUCTURE

FIELD OF THE INVENTION

The invention relates to an electrical connector assembly and a polarization structure for connectors in a header of the electrical connector assembly.

BACKGROUND OF THE INVENTION

According to an electrical connector assembly, as disclosed in U.S. Pat. No. 4,506,949, electrical cable connectors are connected to respective groups of electrical wires. The connectors are adapted for mating connection with a header. The connectors are adapted with electrical contacts connected to the wires to connect the wires to an array of conductive pins projecting through a bottom of the header.

According to U.S. Pat. No. 4,984,992, a cable connector comprises, respective groups of electrical wires terminated with electrical contacts in multiple housing blocks. The housing blocks are nested together in a housing.

Removable keys on a connector are disclosed in U.S. Pat. No. 4,773,881. The keys are joined to the connector by weakened areas. Each of the weakened areas can be broken to remove a selected key from the connector.

SUMMARY OF THE INVENTION

A feature of the invention resides in a removable key for a connector, for replacement by another key having a different keying combination, and the key having removable fingers to determine the keying combination.

Another feature of the invention resides in a connector having posts and latches for retaining a key in the form of a removable clip from which removable fingers project.

According to the invention, an electrical connector assembly comprises, a header through which conductive pins extend, keying elements in the header, at least one electrical connector for connection to some of the pins, at least one external key on the connector being received by the keying elements to align the connector for connection with selected pins, the key being removable for replacement by another key, and a combination of removable fingers of the key comprising; at least one remaining finger on the key, the remaining finger being received by the keying elements.

An embodiment of the invention will now be described by way of example with reference to the accompanying drawings, according to which:

DETAILED DESCRIPTION

Figure 1:
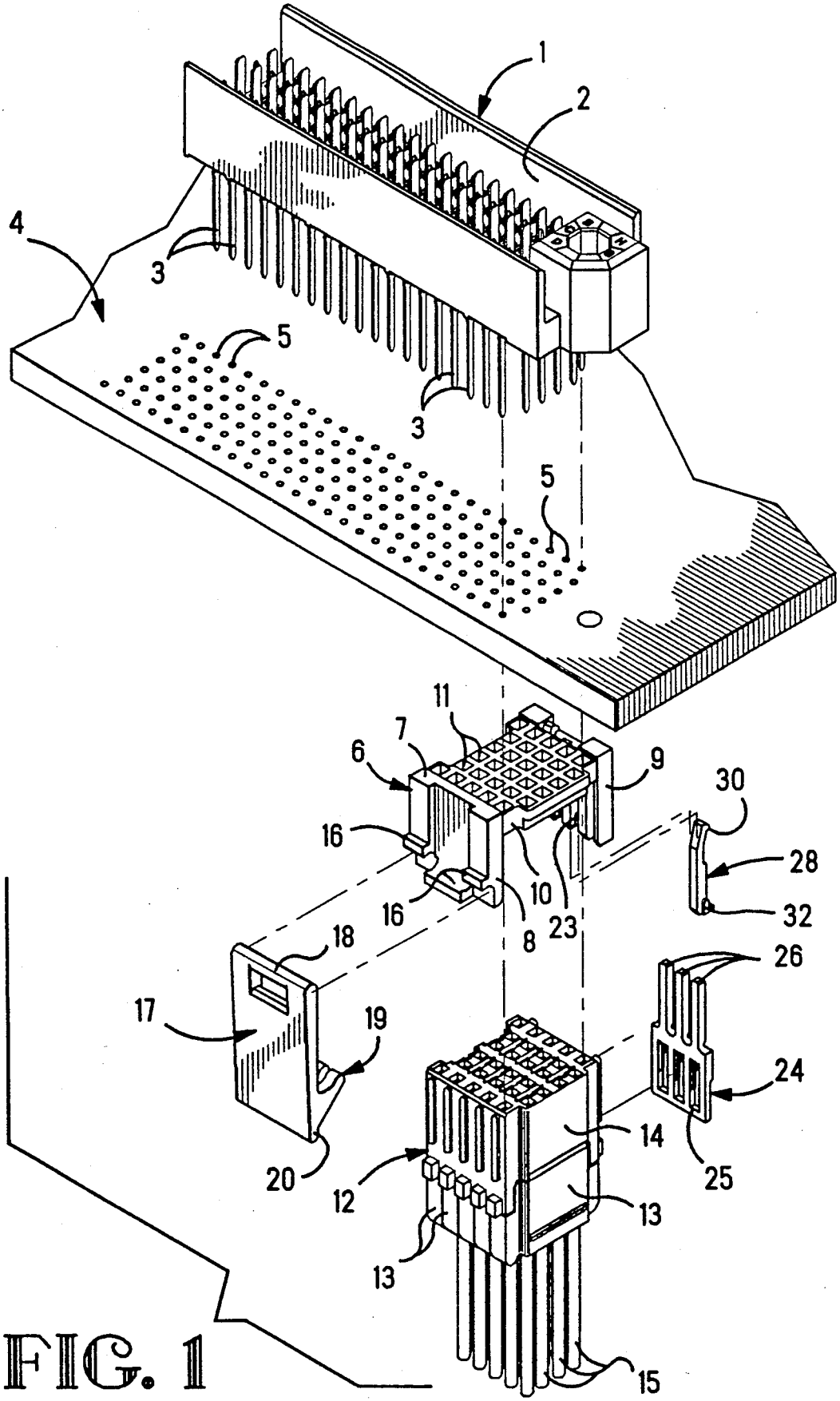
FIG. 1 is a perspective view of a connector assembly and a circuit board and an array of pins in another connector assembly, with parts separated from one another.

With reference to FIG. 1, an electrical connector assembly 1 comprises an insulating housing 2 and an array of conductive pins 3 arranged in a grid. The connector assembly 1 is mounted on a side of a circuit board 4. The pins 3 project from the housing 2 of the electrical connector assembly 1, and extend through apertures 5 in the circuit board 4. The pins 3 project from an opposite side of the circuit board 4.

Mounted on the circuit board 4 is an electrical connector assembly 6 that comprises; a channel shaped header 7 with side walls 8, 9 and a bottom 10 having an array of passages 11 through which the conductive pins 3 extend into the header 7. The electrical connector 12 comprises, an insulating housing block 13 assembled with an insulating housing 14. Further details of the construction are disclosed in U.S. Pat. No. 4,984,992. According to such construction, respective groups of electrical conductors or wires 15 are terminated with electrical contacts, not shown, in respective housing blocks 13 for each group of wires 15. The connector 12, being adapted with the electrical contacts, not shown, connect the wires 15 to respective pins 3 that are arranged in a row of the grid, and that project through the bottom 10 of the header 7.

Figure 2:
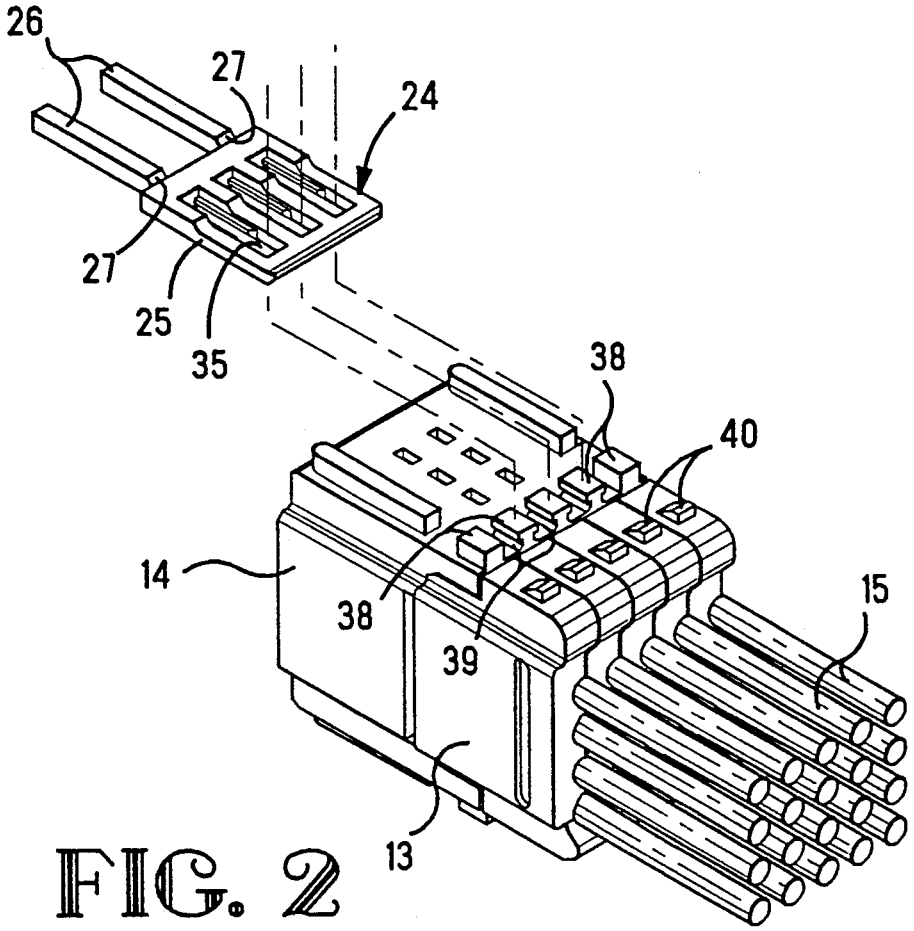
FIG. 2 is a perspective view of a connector with parts separated from one another.
Figure 3:
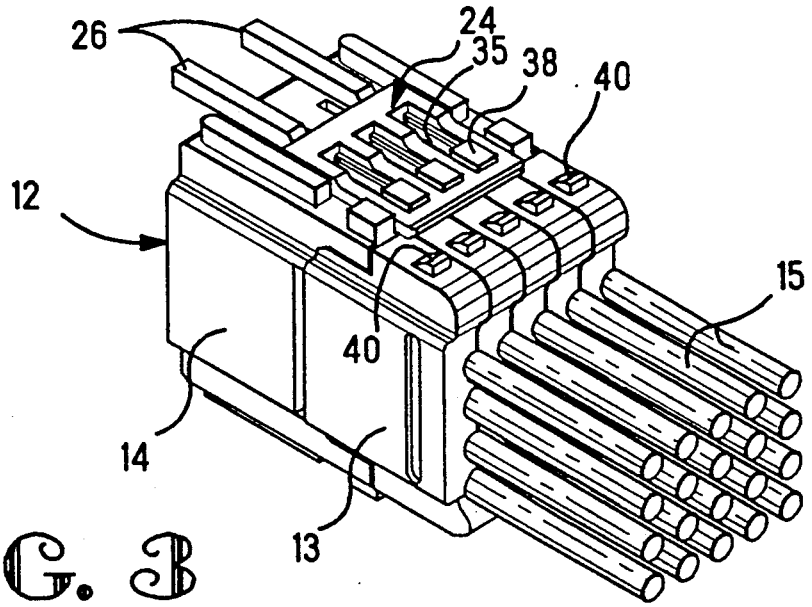
FIG. 3 is a perspective view of another connector with parts separated from one another.

With reference to FIGS. 1-3, the header 7 is of one piece molded polymer construction. Along a first exterior side 8 of the header 7 project integral, curved, spaced apart, hinge knuckles 16. A separate latch 17 having at one end a cylindrical hinge pin 18, and at an opposite end, a curved hook 19 pivotable about the hinge pin 18 that extends through the knuckles 16. A lever 20 projects diagonally from the hook 19, and is grasped to pivot the hook 19 about the hinge pin 18.

The hook 19 is adapted to impinge at least one connector 12. The hook 19 extends transverse to multiple rows of the pins 3. The hook 19 is as wide as the breadth of five rows of pins 3. The hook 19 can impinge multiple housing blocks 13 that nest together in the housing 13. Multiple connectors 12 can nest together in the header 7. The hook 19 is divided into a series of hook teeth 21. Each connector 12 is constructed with a unitary ledge 22 along said housing block 13 onto which the hook 19 is impinged to retain said connector 12 in the header 7. At least one of the hook teeth 21 impinges the ledge 22 of the connector 12.

Keying elements 23 in the form of a series of parallel keyways are in at least one of the walls 9 of the header 7. At least one external key 24 is assembled on the connector 12 to connect with at least one of the keying elements 23, and align the connector 12 in the header 7 for connection to the pins 3. The latch 17 and the keying elements 23 are on different walls 8 and 9. The key 24 comprises, a clip 25 from which project integral, removable fingers 26 joined to the clip 25 by weakened areas defined by score lines 27.

With reference to FIGS. 1 and 2, one of three fingers 26 is removed by severing at the score line 27, leaving two fingers 26 remaining and attached to the clip 25 of the key 24. The key 24 is then assembled to the connector 12. The remaining fingers 26 of the key 24 are received along respective keyways of the keying elements 23 in the side of the header 7. A separate plug 28 is inserted in a keyway that would have received the finger 26 that was removed. In this manner, the keying combination on the connector 12, provided by a removed finger 26 of the key 24, will match the keying combination of the header 7, provided by the plug 28 in the appropriate keyway of the keying elements 23. Keying combinations vary from, at least one finger 26 remaining on the key 24, to all of the fingers 26 remaining on the key 24. The plug 28 can be used to block a portion of the header 7 from entry of the key 24 having all the fingers 26 remaining on the key 24.

Figure 5:
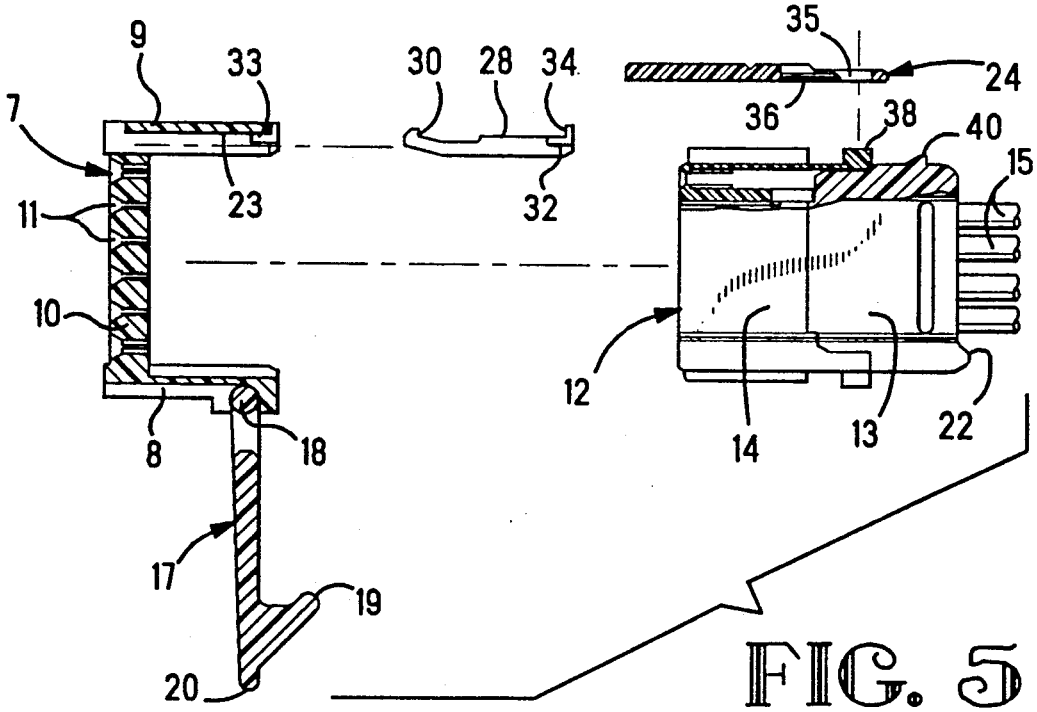
FIG. 5 is a perspective view of the connector as shown in FIG. 3, with the parts assembled together.
Figure 6:
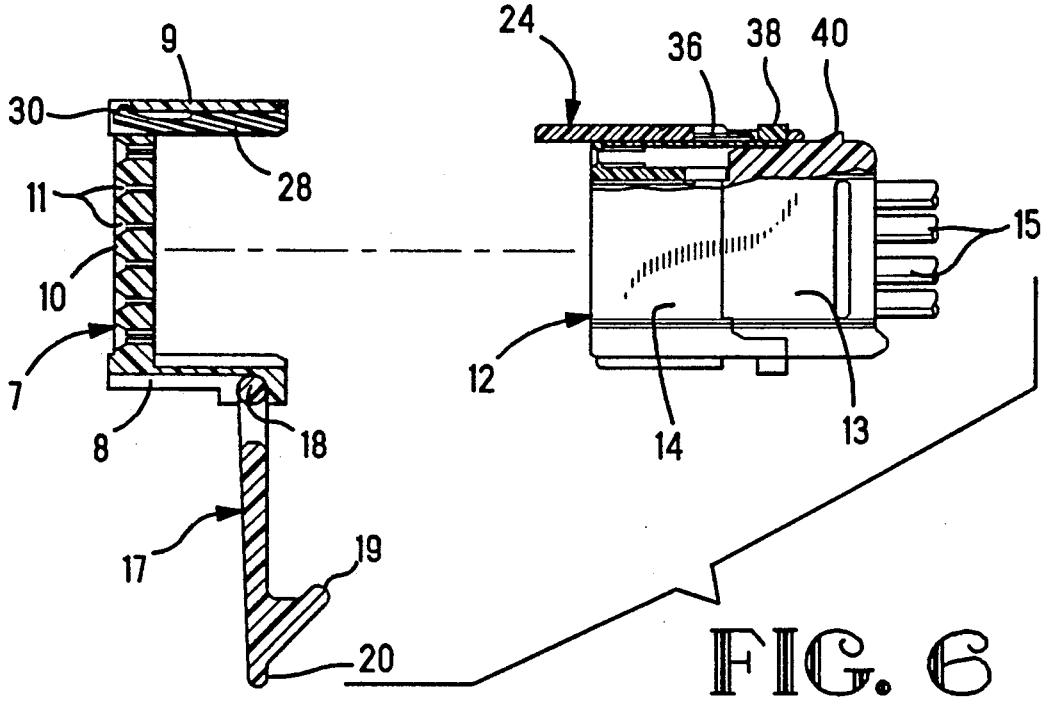
FIG. 6 is a section view of a header and the connector as shown in FIG. 5, with parts separated from one another.
Figure 7:
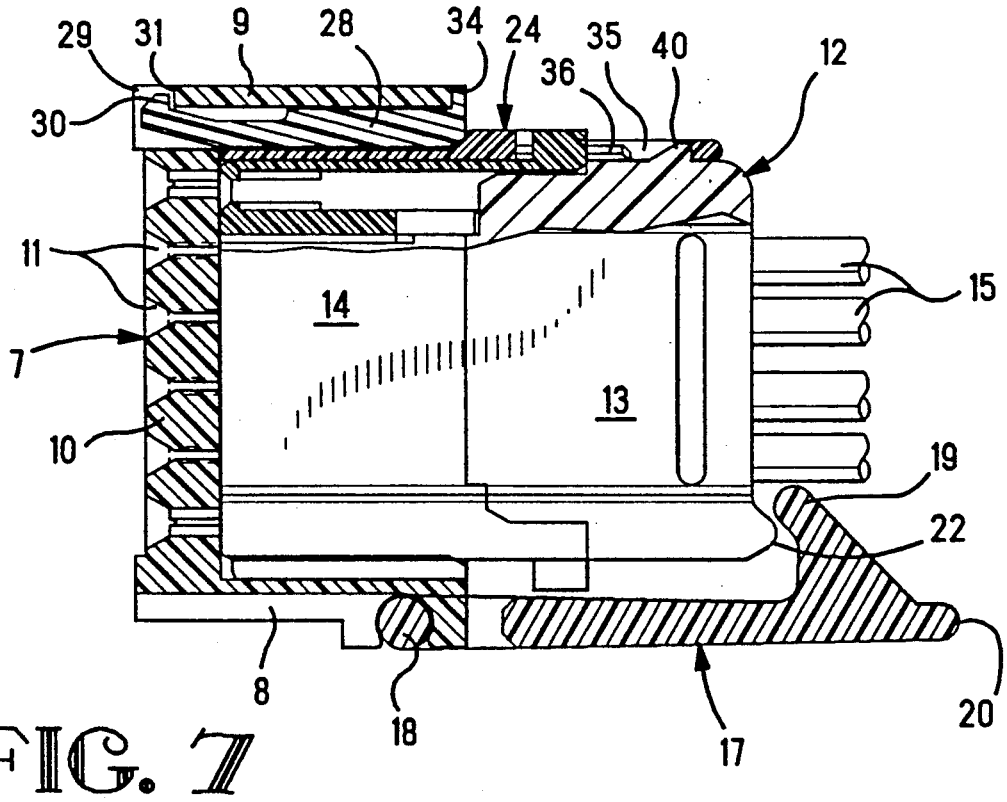
FIG. 7 is a view similar to FIG. 6, with the parts assembled.

With reference to FIGS. 5–7, each of the keyways of the keying elements 23 communicates with an opening 29 extending through the exterior side of the housing 14 of the connector 12. The plug 28 is adapted with a hook 30 at one end that registers in an opening 29 and latches in the opening 29 against a shoulder 31 at the intersection of the opening 29 with the keyway of the keying elements 23. The hook 30 is curved and is narrower than the keyway, such that the hook 30 can be deflected out of the opening 29 and resiliently deflected into the keyway, allowing removal of the entire plug 28, for example, to change the keying combination by relocating the plug 28 in another keyway. At an opposite end of the plug 28, projecting tongues 32 fit into respective grooves 33 inset along the ends of the keyways. Transverse flanges 34 on the tongues 33 are useful to pry against, causing the hook 30 to dislodge from the opening 29 and allow removal of the plug 28 from the keyway.

Figure 4:
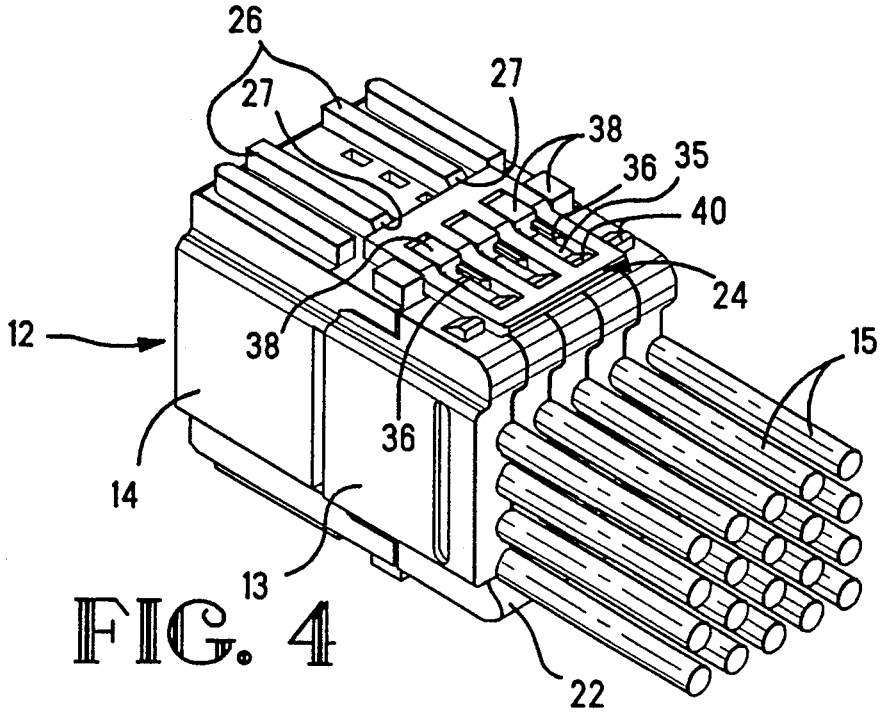
FIG. 4 is a perspective view of the connector as shown in FIG. 2, with the parts assembled together.

With reference to FIGS. 2–4, details of the key 24 will be described. Multiple slots 35 of the clip 25 have closed ends, and are parallel and spaced apart. Side rails 36 in the slots 35 are on opposite sides of the slots 35, and face each other. The rails 36 restrict the width of the slots 35. The rails 36 are shorter in length than the slots 35 to provide full width portions 37 of the slots 35 adjacent one of the closed ends of each of the slots 35.

Figure 8:
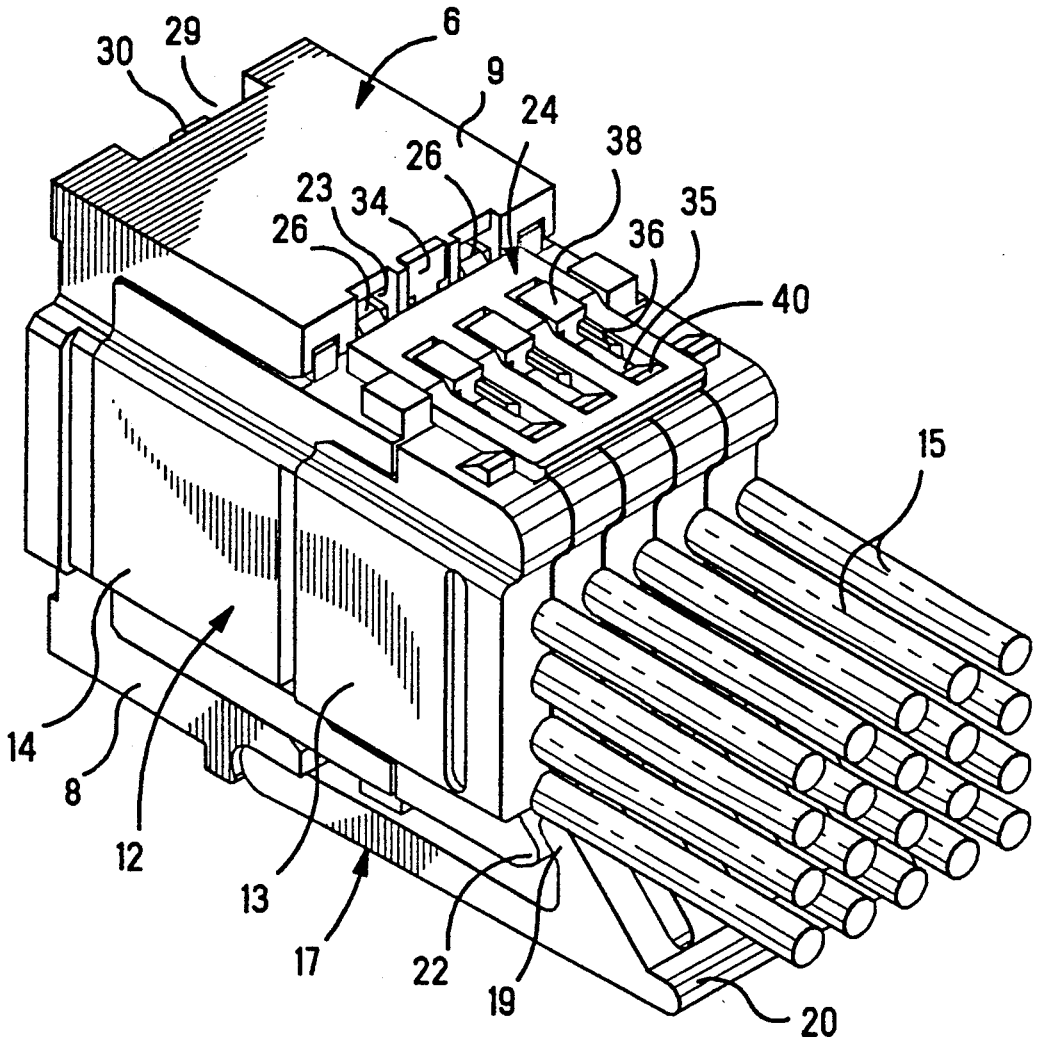
FIG. 8 is a perspective view of the connector as shown in FIG. 5, together with a header.

With reference to FIGS. 2–4, the housing 14 of the connector 12 will be described in further detail. Projecting posts 38 on a side of the housing are in a row, and are spaced apart to correspond with the spacings of the slots 35 in the clip 25. When the clip 25 is applied over the posts 38, the widths of the posts 37 fill the full width portions 37 of the slots 35, FIG. 3. The rails 36 extend in the remainder of the slots 35 that extend beyond the posts 38. There are undercut channels 39 in sides of the posts 38 to receive the rails 36, FIGS. 2 and 8. Sliding the clip 25 will move the slots 35 relative to the posts 38, causing the rails 36 to enter and slide along the channels 39 in the posts 38. Latches in the form of inclined wedge, projections 40 are in a row, spaced from the posts 38. Sliding the clip 25 will cause the clip 25 to ride over the inclined projections 40 until the projections 40 enter the full width portions 37 of the slots 35. The clip 25 is slightly bent resiliently while riding over the inclined projections 40. Once the projections 40 enter the slots 35, the clip 25 resiliently straightens to flatten against the connector 12. The projections 40 latch in the slots 35, and restrain further movement of the slots 35 relative to the posts 38. The posts 38 restrain the rails 36 from movement outwardly away from the connector 12. The fingers 26 are against the connector 12, FIG. 8. The clip 25 is removable from the connector 12 for replacement by another clip 25, for example, a clip 25 having a different combination of fingers 26. To remove the clip 25, the clip 25 is bent resiliently to dislodge the slots 35 from the projections 40. The clip 25 then is slid in a reverse direction to remove the rails 36 from the channels 39.

Other embodiments and modifications of the invention, and accompanying advantages, are intended to be included in the spirit and scope of the claims.

We claim:

1. An electrical connector assembly comprising: a header with side walls and a bottom through which conductive pins extend, keying elements in at least one of the walls of the header, at least one electrical connector for connection to some of the pins, at least one external key on the connector being received by the keying elements to align the connector for connection with selected pins, the key being removable for replacement by another key, a combination of removable fingers of the key comprising; multiple fingers on the key linked together on a clip, each of the fingers being constructed to be removable from the clip, at least one finger remaining on the key following removal of at least a second finger from the clip, the remaining finger being received by the keying elements, at least one plug mounted to one of the keying elements in place of the second finger that is absent from the clip, and latches on the connector latching the clip removably to the connector, whereby the clip is removable from the connector for replacement by another clip.

2. An electrical connector assembly as recited in claim 1, comprising: the keying elements being in the form of a series of keyways aligned with and receiving said fingers.

3. An electrical connector assembly as recited in claim 2, comprising: the plug being a separate plug inserted in a keyway of the keying elements.

4. An electrical connector assembly as recited in claim 3, comprising: the plug being adapted with a hook at one end that latches in an opening communicating with the keyway.

5. An electrical connector assembly as recited in claim 4, comprising: the hook being curved and narrower than the keyway, such that the hook can be deflected out of the opening and resiliently deflected into the keyway, allowing removal of the plug.

6. An electrical connector assembly as recited in claim 4, comprising: transverse flanges on the plug to pry against and to dislodge the plug.

7. An electrical connector assembly as recited in claim 1, comprising: the key being adapted with multiple slots in the clip, rails in the slots being shorter in length than the slots, projecting posts on the connector received in the slots, projecting latches on the housing spaced from the posts, and the clip being slidable to move the rails into channels of the posts, and to latch the clip against the latches.

8. An electrical connector assembly comprising: a header with side walls and a bottom through which conductive pins extend, keying elements in the header, at least one electrical connector for connection to some of the pins, at least one external key on the connector being received by the keying elements to align the connector for connection with selected pins, the key being adapted with multiple slots in a clip, rails in the slots being shorter in length than the slots, projecting posts on the connector received in the slots, channels in the posts, projecting latches on the housing spaced from the posts, the clip being slidable to move the rails into the channels and to latch the clip against the latches, the clip being constructed with removable fingers constructed for removable connection to the clip, the clip being constructed such that at least one said finger is absent from the clip, latches on the connector latching the clip removably to the connector, whereby the clip is removable from the connector for replacement by another clip, and at least one plug mounted to one of the keying elements in place of the finger that is absent from the clip.

9. An electrical connector assembly as recited in claim 8, comprising: the keying elements being in the form of a series of keyways aligned with and receiving said fingers.

10. An electrical connector assembly as recited in claim 9, comprising: the plug being a separate plug inserted in a keyway of the keying elements.

11. An electrical connector assembly as recited in claim 10, comprising: the plug being adapted with a hook at one end that latches in an opening communicating with the keyway.

12. An electrical connector assembly as recited in claim 11, comprising: the hook being curved and narrower than the keyway, such that the hook can be deflected out of the opening and resiliently deflected into the keyway, allowing removal of the plug.

13. An electrical connector assembly as recited in claim 11, comprising: transverse flanges on the plug to pry against and to dislodge the plug.

14. An electrical connector assembly comprising: a header with side walls and a bottom through which conductive pins extend, keying elements in the header, at least one electrical connector for connection to some of the pins, at least one external key on the connector being received by the keying elements to align the connector for connection with selected pins, the key being adapted with multiple slots in a clip, rails in the slots being shorter in length than the slots, projecting posts on the connector received in the slots, channels in the posts, projecting latches on the housing spaced from the posts, the clip being slidable to move the rails into the channels and to latch the latches in the slots in the clip.

* * * * *